United States Patent [19]

Bakanowski et al.

[11] Patent Number: 4,464,554

[45] Date of Patent: Aug. 7, 1984

[54] DYNAMIC BOTTOM FEED FOR MICROWAVE OVENS

[75] Inventors: Stephen M. Bakanowski; Matthew S. Miller, both of Louisville, Ky.

[73] Assignee: General Electric Company, Louisville, Ky.

[21] Appl. No.: 411,153

[22] Filed: Aug. 25, 1982

[51] Int. Cl.[3] ..... H05B 9/06

[52] U.S. Cl. ..... 219/10.55 F; 219/10.55 R

[58] Field of Search ..... 219/10.55 F, 10.55 A, 219/10.55 R, 10.55 M; 34/1

[56] References Cited

U.S. PATENT DOCUMENTS

| | | | |
|---|---|---|---|
| 2,704,802 | 3/1955 | Blass et al. | 219/10.55 |
| 3,810,248 | 5/1974 | Risman et al. | 219/10.55 |
| 3,843,863 | 10/1974 | Fitzmayer | 219/10.55 F |
| 4,019,009 | 4/1977 | Kusunoki et al. | 219/10.55 |
| 4,324,968 | 4/1982 | Smith | 219/10.55 |
| 4,336,434 | 6/1982 | Miller | 219/10.55 |
| 4,354,083 | 10/1982 | Staats | 219/10.55 F |

FOREIGN PATENT DOCUMENTS

| | | | |
|---|---|---|---|
| 2154344 | 11/1979 | Fed. Rep. of Germany F | 219/10.55 |

*Primary Examiner*—Roy N. Envall, Jr.
*Assistant Examiner*—M. Lateef
*Attorney, Agent, or Firm*—H. Neil Houser; Radford M. Reams

[57] ABSTRACT

An excitation system for a microwave cooking appliance includes a waveguide along one wall arranged to support a standing wave therein, with an array of apertures spaced along the length of the waveguide to couple energy from the waveguide to the cooking cavity. A phase shifting device periodically shifts the phase of the standing wave between a first phase relationship and a second phase relationship. The array of radiating apertures is configured to support a first and a second substantially stationary radiating pattern when the first and second phase relationships, respectively, are established for the standing wave in the waveguide. Each radiating pattern at the cooking plane has regions of relatively high energy density interspersed wth regions of relatively low energy density, with the high energy regions of one pattern overlying low energy regions of the other, such that by periodically switching between patterns the uniformity of the time-averaged energy density at the cooking plane is enhanced.

13 Claims, 13 Drawing Figures

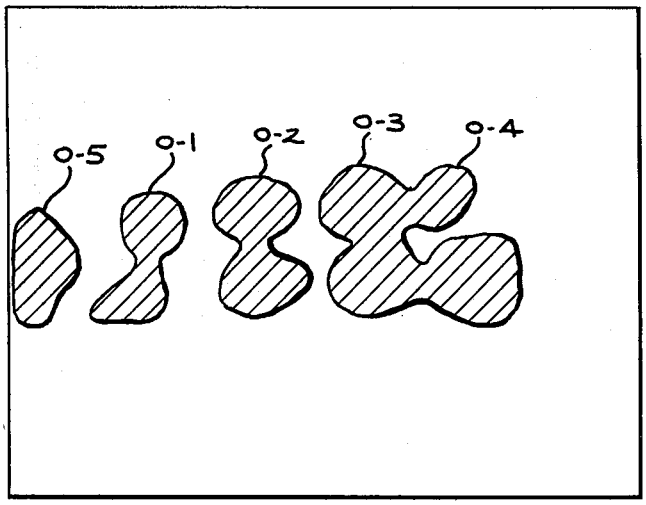
FIG. 7
FIG. 8
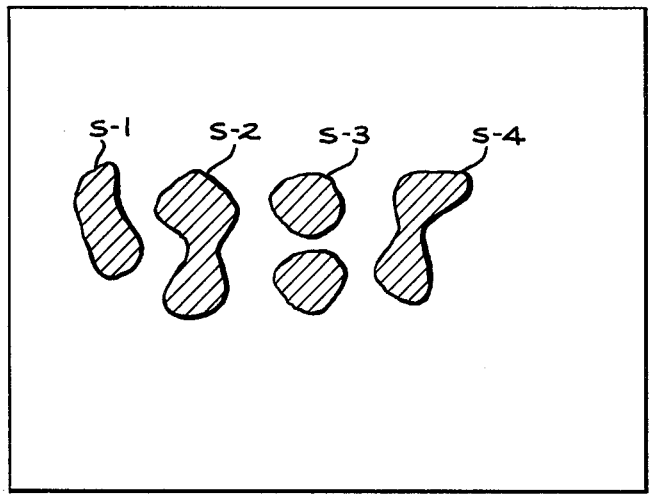
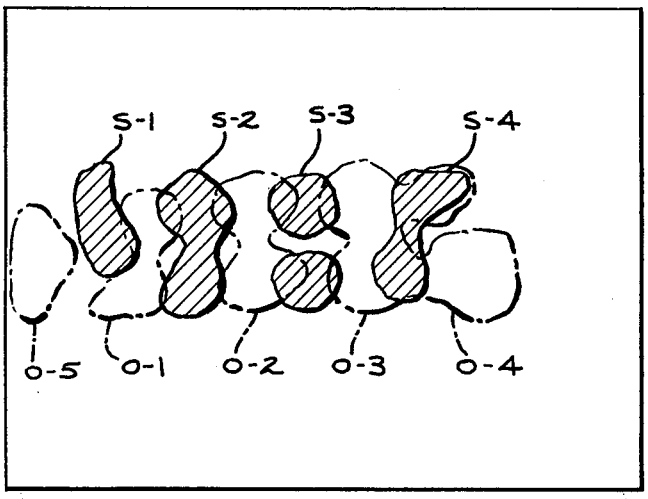
FIG. 9

DYNAMIC BOTTOM FEED FOR MICROWAVE OVENS

BACKGROUND OF THE INVENTION

The present invention relates generally to microwave cooking appliances and more particularly to microwave oven cooking cavity excitation systems for promoting time-averaged uniformity of microwave energy distribution in the cooking cavity.

A problem of long standing in microwave oven appliances has been the non-uniform spatial distribution of microwave energy in the cooking cavity. This non-uniform energy distribution results in hot spots and cold spots at different locations in the cavity. For many types of foods, cooking results are unsatisfactory under such conditions because some portions of the food may be completely cooked while others are barely warmed. The problem becomes more severe with foods of low thermal conductivity which do not readily conduct heat from the areas which are heated by the microwave energy to those areas which are not. One example of such a food is cake.

In an effort to alleviate the problem of non-uniform energy distribution, a great many approaches have been tried. One common approach is the use of a device known as a mode stirrer which typically resembles a fan having metal blades. The mode stirrer rotates and may be placed either within the cooking cavity itself (usually protected by a cover constructed of a material transparent to microwaves) or to conserve space within the cooking cavity the stirrer may be mounted within a recess formed in one of the cooking cavity walls, normally the top. The function of the mode stirrer is to continually alter the mode pattern within the cooking cavity.

Another approach to the problem of non-uniform energy distribution is disclosed in commonly-assigned U.S. Pat. No. 4,336,434, issued June 22, 1982 to Matthew S. Miller, entitled "Microwave Oven Cavity Excitation System Employing Circularly Polarized Beam Steering for Uniformity of Energy Distribution and Improved Impedance Matching." The disclosed Miller microwave oven cavity excitation system introduces circularly polarized electromagnetic wave energy into a cooking cavity through a pair of feed points appropriately phased to provide a concentrated beam. The relative phasing of the feed points is varied as a function of time to steer the concentrated beam to sweep the interior of the cavity, thereby improving the time-averaged energy distribution within the cooking cavity. Further, the disclosure of the Miller patent points out that as a result of the circular polarization, standing waves in the direction of one of the cavity dimensions are minimized and the amount of energy reflected back to the generator is reduced. The Miller patent also shows how various forms of coupling apertures or slots in a rectangular waveguide can be located with respect to the waveguide so as to radiate a circularly polarized electromagnetic field.

Another approach involving a modification of the above-identified Miller patent is disclosed in commonly-assigned U.S. Pat. No. 4,324,968, issued Apr. 13, 1982 to Peter H. Smith and entitled "Microwave Oven Cavity Excitation System Providing Controlled Electric Field Shape for Uniformity of Energy Distribution." The Smith oven cavity excitation system provides a coupling aperture such as an X slot for radiating microwave energy from a feed wave guide into the adjacent cooking cavity, which slot is effectively controllably and selectively moved with respect to the wave guide centerline with the result that the sectional shape of the resulting field, viewed for example in the plane of the food supported on a conventionally located shelf, changes from circular to elliptical with the degree and orientation of the ellipse depending upon the direction and degree of movement of the coupling aperture with respect to the waveguide centerline. Rather than physically moving the aperture, a device is provided for varying the electrical position of the coupling aperture with respect to the centerline of the waveguide as a function of time.

Yet another approach to the problem is disclosed in commonly-assigned, copending application, Ser. No. 363,705, filed Mar. 30, 1982 by Dills et al, and entitled "Microwave Oven with Dual Feed Excitation System." The disclosed Dills et al excitation system employs a rotating antenna in combination with a slotted feed arrangement which interacts so as to improve the efficiency and uniformity of heating within the cavity. The rotating antenna radiates a dynamic field from the top wall of the cavity and the slotted bottom feed radiates a static field from a radiating chamber extending along the bottom cavity wall and having an array of radiating slots formed along the top face of the chamber. The slots are arranged to establish a substantially stationary radiation pattern in the cavity which complements the average radiation pattern of the antenna by filling those portions of the antenna pattern of relatively low energy density. Since the impedance of the antenna load is a function of the angular orientation of the antenna in the cavity, this impedance varies as the antenna rotates. The antenna and the chamber are both fed from a common source; thus, the proportion of total energy delivered to the chamber fluctuates as the antenna load impedance fluctuates, causing the intensity of the output of the radiating chamber slots to fluctuate accordingly. This interaction of the dynamic rotating antenna and the static radiating chamber results in a more uniform energy distribution throughout the cavity when time-averaged over the cooking period.

In addition to the above-referenced Dills et al application, other microwave oven excitation systems employing slotted feed arrangements known in the microwave art include U.S. Pat. No. 4,019,009 to Kusonoki et al; U.S. Pat. No. 2,704,802 to Blass et al; and U.S. Pat. No. 3,810,248 to Risman et al. The slotted feed arrangement of the Kusonoki et al type uses surface wave phenomena for near field heating. Such an arrangement tends to primarily heat the portion of the load nearest the slots and works less well for relatively thin slot loads. For other types of loads, the surface waves are supplemented by energy radiated into the cavity from the top or sides. Slotted feed arrangements such as that of Blass et al and Risman et al tend to create standing waves in the cavity with resultant cold spots at the nodes of the standing waves. Commonly-assigned, U.S. Pat. No. 4,354,083 to James E. Staats, provides an example of a dual feed system using slotted radiators in the top and bottom cavity walls. A shelf is positioned immediately above the bottom slots to heat food supported on the shelf from the bottom by use of near field heating effect, while the slots radiate microwave energy to illuminate the upper portion of the food load. In each of these slotted feed arrangements the essentially static field is supported in the cavity by the slotted feed radiators.

While the various approaches to the problem of non-uniform energy distribution in microwave cavities summarized hereinbefore have achieved varying degrees of success in improving cooking performance, it will be appreciated that the achievement of time-averaged uniformity of energy distribution is a formidable consideration in the development of practical microwave ovens.

It is therefore an object of the present invention to provide a microwave oven excitation system which provides improved uniformity of time-averaged energy distribution in the oven cavity to more effectively cook even those foods having low thermal conductivity properties with an excitation system of relatively simple and inexpensive construction and with a minimum of mechanically moving parts for reduced cost and greater reliability of operation.

SUMMARY OF THE INVENTION

A microwave cooking appliance is provided with an excitation system which promotes the time-averaged uniformity of energy distribution at the cooking plane in the cooking cavity. The excitation system includes a source of microwave energy such as a magnetron which is coupled to a hollow rectangular feed waveguide extending along a wall of the cavity. An electric field characterized by a standing wave field pattern propagates along the length of the guide. Means are provided to periodically shift the phase of the standing wave in the guide between a first phase relationship and a second phase relationship.

An array of microwave energy radiating apertures are provided along the length of the waveguide to couple energy into the cooking cavity. This array of apertures is physically configured to support a first substantially stationary radiation pattern in the cooking cavity when the first phase relationship for the standing wave is established in the waveguide and to establish a second essentially stationary radiation pattern in the cooking cavity when the second phase relationship is established for the standing wave in the waveguide.

The cooking plane is defined by the surface in the cavity which suports objects to be heated therein. Each of the radiating patterns has regions of relatively high energy density at the cooking plane in the cavity interspersed from side to side in the cavity with regions of relatively low intensity. The patterns are laterally offset such that the relatively high energy density regions of one pattern substantially overlie relatively low energy density regions of the other. By periodically switching from one pattern to the other, the uniformity of the time-averaged energy density at the cooking plane is enhanced.

In one form of the invention, the end wall of the waveguide has formed therein an aperture to provide an open circuit termination for the waveguide. When so terminated, a maximum field point, i.e., a standing wave maximum, exists at the end wall. This defines the first phase relationship for the standing wave in the waveguide. Means are provided to periodically effectively short circuit the aperture, thereby converting the guide termination from an open circuit termination to a closed circuit termination. When so terminated, a minimum field point or standing wave node exists at the end wall. This defines a second phase relationship for the standing wave in the waveguide, shifted a quarter waveguide wavelength relative to the first phase relationship.

BRIEF DESCRIPTION OF THE DRAWINGS

While the novel features of the invention are set forth with particularly in the appended claims, the invention both as to organization and content will be better understood and appreciated from the following detailed description taken in conjunction with the drawings in which:

FIG. 7 is a sketch of the radiation pattern at the cooking plane from the bottom waveguide when the waveguide is terminated by an open circuit;

FIG. 8 is a sketch of the radiation pattern at the cooking plane from the bottom waveguide when the waveguide is terminated by a short circuit;

FIG. 9 is a sketch of the radiation pattern of FIG. 7 superimposed over the radiation pattern of FIG. 8 to illustrate the interleaving of the patterns;

DETAILED DESCRIPTION

Figure 1:
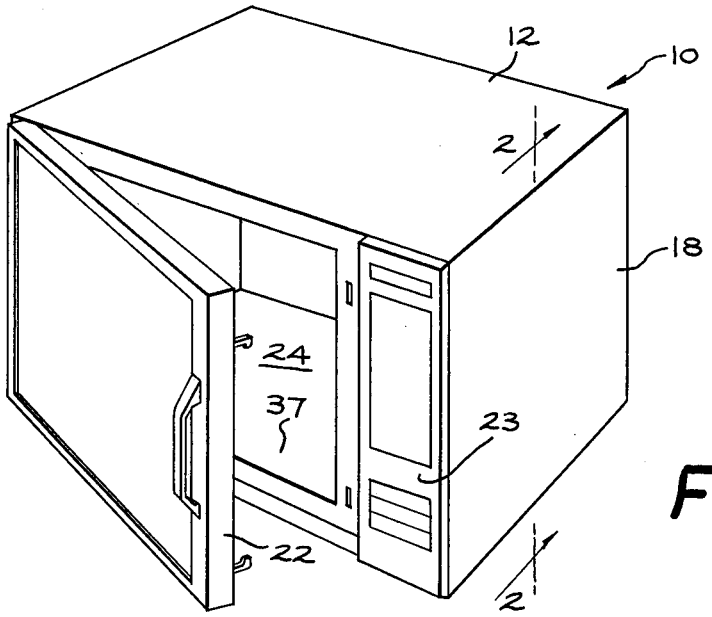
FIG. 1 is a front perspective view of a microwave oven.
Figure 6:
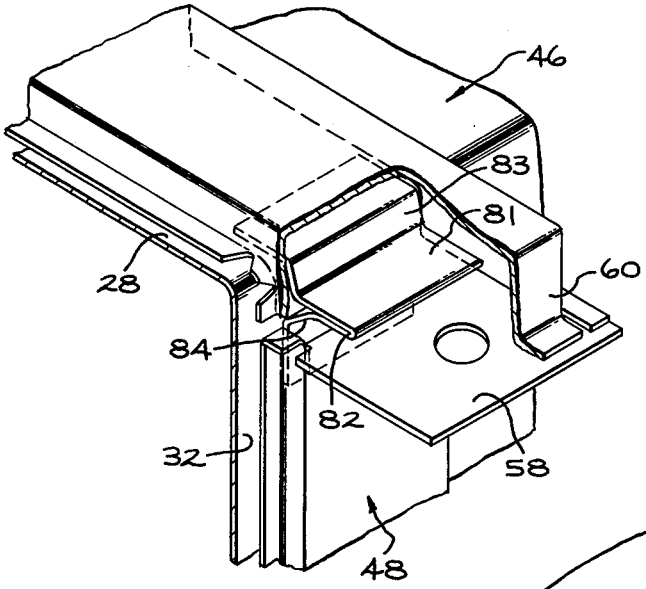
FIG. 6 is an enlarged perspective view of a portion of the microwave oven of FIG. 1, with portions removed to show the details of the bifurcator at the junction of the upper waveguide, side waveguide and microwave launch area.

Referring now to FIGS. 1–5, there is shown a microwave oven designated generally 10. The other cabinet comprises six cabinet walls including upper and lower walls 12 and 14, a rear wall 16, two side walls 18 and 20, and a front wall partly formed by hingedly supported door 22 and partly by control panel 23. The space inside the outer cabinet is divided generally into a cooking cavity 24 and a control compartment 26. The cooking cavity 24 includes a conductive top wall 28, a conductive bottom wall 30, conductive side walls 32 and 34, conductive rear wall, which wall is the cabinet wall 16, and the front wall defined by the inner face 36 of door 22. Nominal dimensions of cavity 24 are 16 inches wide by 13.67 inches high by 13.38 inches deep.

A support plate 37 of microwave pervious dielectric material such as that available commercially under the trademark "Pyroceram" or "Neoceram" is disposed in the lower region of cavity 24 substantially parallel to bottom cabinet wall 14. Support plate 37 provides the means for supporting food objects to be heated in the cavity 24, and defines a plane hereinafter referred to as the cooking plane. Plate 37 is supported from a support strip 38 which circumscribes cavity 24. Strip 38 is secured front to back along cavity side walls 32 and 34 and side to side from bottom wall 30 by expandable tabs 39 which project through small holes spaced along front and back edges of bottom wall 30 and side walls 32 and 34.

The source of microwave energy for cavity 24 is magnetron 40 which is mounted in control compartment 26. Magnetron 40 has a center frequency of approximately 2450 MHz at its output probe 42 when coupled to a suitable source of power (not shown) such as the 120 volts AC power supply typically available in domestic wall receptacles. In connection with the magnetron, a blower (not shown) provides cooling air flow over the magnetron cooling fins 44. The front facing opening of the controls compartment 26 is enclosed by control panel 23. It will be understood that numerous other components are required in a complete microwave oven, but for clarity of illustration and description, only those elements believed essential for a proper understanding of the present invention are shown and described. Such other elements may all be conventional and as such are well known to those skilled in the art.

Microwave energy is fed from magnetron 40 to the oven cavity 24 through a coupling or transmission means such as a waveguide having a horizontally extending top branch or section 46, a vertically oriented side branch or section 48 and a horizontally extending bottom branch or section 50.

Waveguide sections 46, 48 and 50 are conventionally dimensioned to propagate 2450 MHz microwave energy in the $TE_{10}$ mode. This is accomplished preferably by choosing the width of the section (the dimension running front to rear of the oven) to be more than one-half wavelength but less than one full wavelength and the height of the section (the dimension extruding perpendicular to the adjacent cavity wall) to be less than one-half wavelength. In the illustrative embodiment, the height of sections 46, 48 and 50 are nominally 0.75 inches and the width is nominally 3.66 inches.

Figure 3:
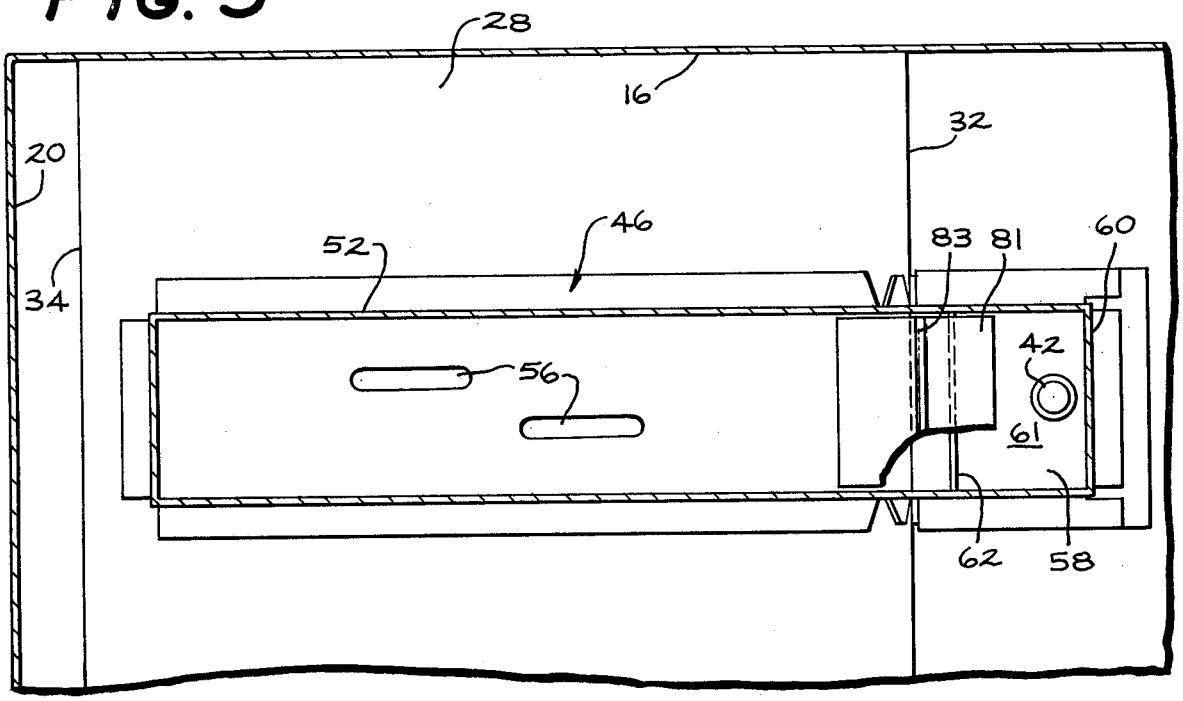
FIG. 3 is a schematic sectional view taken along the lines 3—3 of FIG. 2 showing the slots in the top waveguide.

The upper waveguide branch 46 runs centrally of upper wall 28 of the cooking cavity and, as shown, is formed by elongated member 52 having a generally U-shaped cross section which is attached by suitable means such as welding at the top wall 28 of cooking cavity 24. As best seen in FIG. 3, waveguide branch 46 includes two coupling apertures 56 located in wall 28, through which microwave energy is transmitted into the upper region of the cooking cavity 24. The slots 56 extend parallel to the longitudinal dimension of guide 46. Apertures 56 are shown as being physically open slots in wall 28 but may alternatively be closed by materials known in the art to be pervious to microwave energy.

Waveguide section 46 also includes portions 58 and 60 which extend beyond cavity 24 in the direction of the magnetron 40 to enclose an area 61 which serves as a lauching area for microwave energy originating at probe 42. Conductive wall 60 serves as a short circuiting waveguide termination for area 61 and is spaced approximately one-sixth guide wavelength from probe 42.

The side waveguide branch 48 runs in a vertical direction centrally of cooking cavity side wall 32 and serves to couple the microwave energy from magnetron 40 to bottom waveguide branch 50. Waveguide branch 48 is formed generally by the side wall 32 and an elongated member 62 having a generally U-shaped cross section and suitable flanges for attachment to the side wall 20. A right angle bend is formed by wall portion 49 at the lower end of section 48 to efficiently couple energy from section 48 to section 50.

Microwave energy from launch area 61 in the vicinity of probe 42 of magnetron 40 is split between section 46 and section 48 by bifurcator 80 which operates to provide a stable power split between these sections. Bifurcator 80 is positioned at the junction of three waveguide sections comprising guide sections 46, 48 and launch area 61. The upper portion of bifurcator 80, comprising upper face 81 of horizontally extending divider 82 and step 83, functions as a quarter wave transformer to efficiently match the impedance of guide section 46 to launch area 61 for maximum power transfer. To this end the horizontal length for upper face 81 is a quarter guide wavelength. The height of step portion 83 is chosen as a function of the height of guide sections 46 and launch area 61 in accordance with conventional quarter wave transformer design. The lower portion of bifurcator 80 provides a conventional mitered corner at 84 for proper impedance matching with side waveguide section 48.

In the illustrative embodiment, satisfactory cooking results are achieved by providing 60 percent of the energy to the top waveguide 46 and 40 percent to the bottom waveguide 50 via waveguide 48, which split is stabilized by bifurcator 80. It will be understood, however, that adequate performance could be achieved without bifurcator 80; recognizing that in such an arrangement there could be fluctuations in the power split as a function of the load presented by objects to be heated in the cavity. Also, it will be apparent that a ratio other than 60:40 could be achieved by proper adjustment of the configuration of bifurcator 80.

The bottom waveguide section 50 runs horizontally across the center of bottom wall 30 of cavity 24 approximately underneath waveguide section 46.

Bottom waveguide section 50 is made up of a U-shaped cross section member 68 attached to the flat central section 70 of bottom wall 30 of cooking cavity 24. The U-shaped member 68 includes an upper wall 72 and integral side walls 74 extending downwardly toward the bottom wall 30 of cooking cavity 24. Side walls 74 have suitable flanges 76 to facilitate attachment to the bottom wall 30 in a conventional manner, such as by welding. Open end 64 of section 50 is in communication with side branch 48 to receive microwave energy therefrom. Section 50 is terminated at its other end by end wall 65. An aperture 66 is formed in end wall 65 to provide an open circuit termination for guide section 50.

Figure 4:
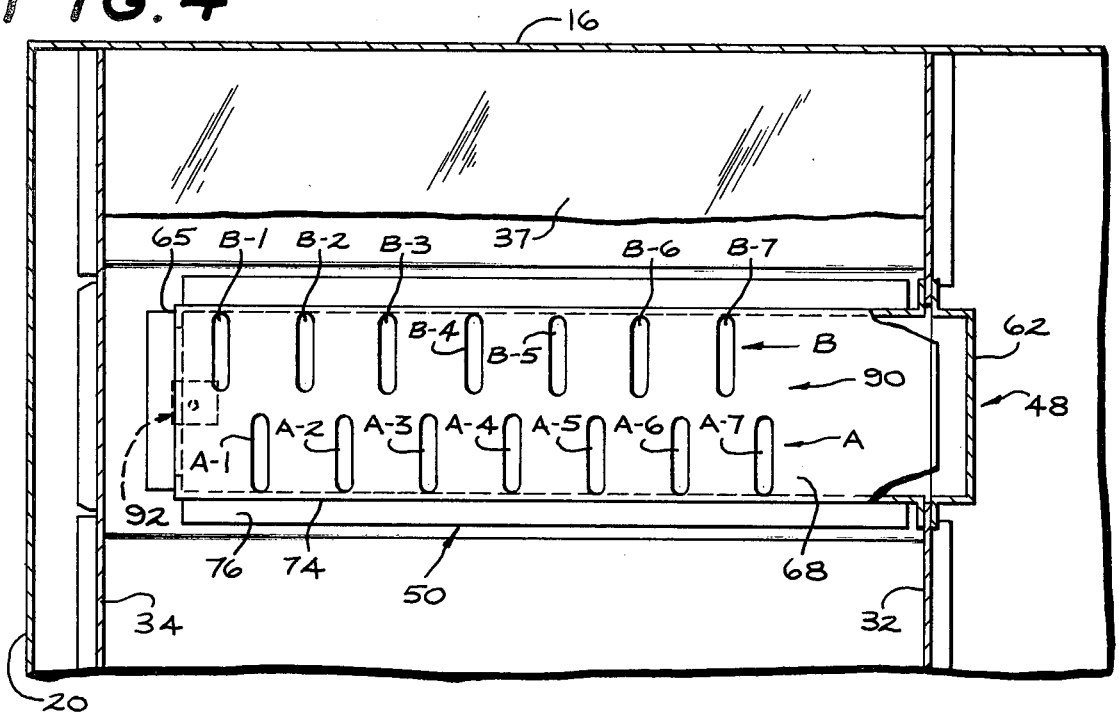
FIG. 4 is a schematic sectional view taken along lines 4—4 of FIG. 2 with portions removed to show the details of the slots in the bottom waveguide.
Figure 5:
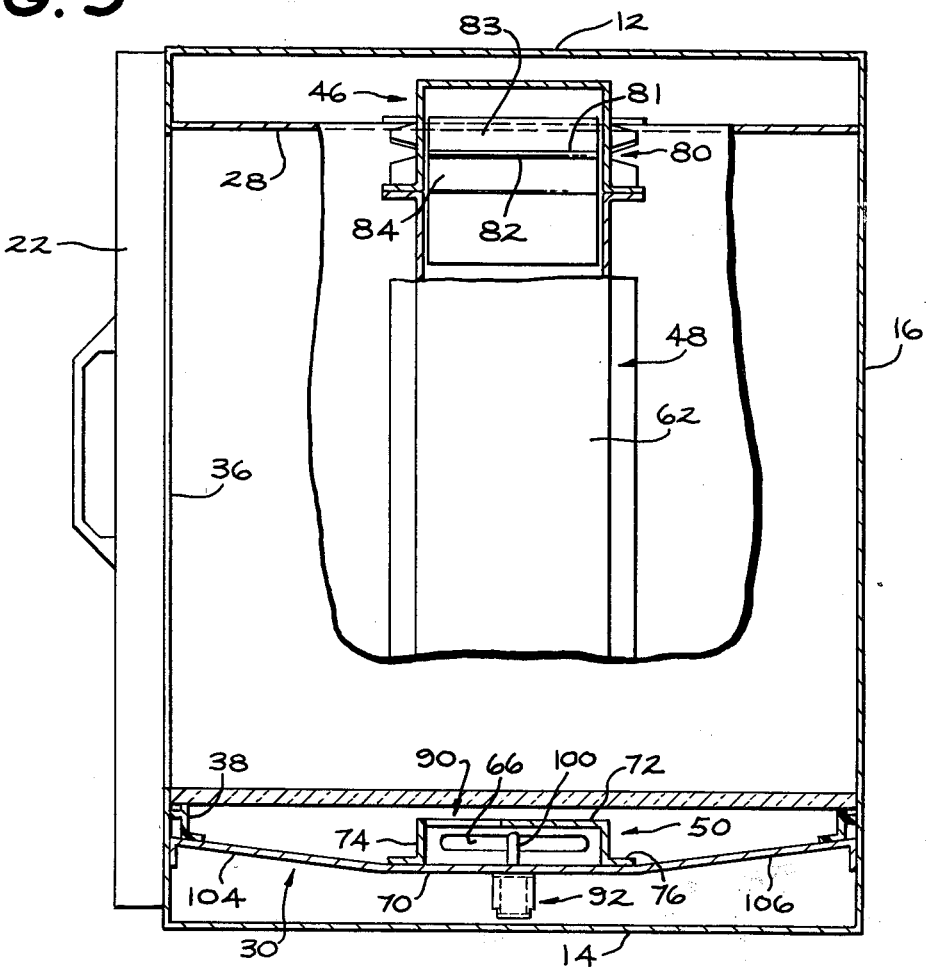
FIG. 5 is a schematic side view partially in section of the microwave oven of FIG. 1 with portions removed to illustrate details thereof.

As best seen in FIG. 4, the upper wall 72 of guide section 50 has formed therein an array of radiating apertures designated generally 90. In accordance with the invention, apertures 90 are arranged to provide two different substantially stationary radiating patterns in cooking cavity 24, depending upon the phase relationship of the standing wave of the electric field established in the waveguide section. The purpose of the two different patterns is to enhance the time-averaged uniformity of energy distribution of the cooking plane. To this end, the patterns are arranged such that the high energy density regions of one pattern as they exit at the cooking plane overlie relatively low energy density regions of the other pattern. By periodically switching between the two patterns, the average energy distribution at the cooking plane is relatively uniform.

In arranging the apertures to provide the desired radiation patterns advantageous use is made of the standing wave nature of the electric field established in guide section 50. In waveguide 50 an electric field is supported between the top and bottom walls of guide section 50, which field is characterized as a standing wave having a certain phase relationship in the guide defined in terms of either the location of the nodes of the standing wave or the maximum field points, relative to the end wall 65 of guide section 50. One effect of the open circuit termination for guide section 50 provided by aperture 66 is to establish a maximum field point at end wall 65, or in terms of wave phenomena a wave maximum at the plane of end wall 65. This defines a first phase relationship for the standing wave in guide 50. When this relationship exists in the waveguide, a first radiating pattern is established in cooking cavity 24.

As will be described in greater detail hereinafter, means is also provided for periodically effectively shorting the open circuit termination of aperture 66 thereby converting the termination from an open circuit termination to a short circuit termination. The short circuit termination establishes a zero field point or wave node at the termination point which is in close proximity to end wall 65 thereby effectively shifting the nodes and maximum points of the standing wave in guide section 50 by a quarter guide wavelength. The establishment of a field minimum at or in close proximity to end wall 65 defines the second phase relationship for the standing waveguide section 50. Establishment of this second phase relationship in the guide section 50 results in the establishment of the second radiating pattern in cooking cavity 24.

Before describing in detail the aperture configurations utilized to achieve two desired radiation patterns, the basic patterns themselves will be described with reference to FIGS. 7, 8 and 9, which are sketches of representative energy distribution patterns at the cooking plane for the oven of the illustrative embodiment, observed via infrared thermography techniques using a sheet of material with dielectric properties similar to typical food loads. FIGS. 7 and 8 represent the energy distribution with waveguide 50 terminated by an open circuit and by a short circuit, respectively. The cross hatched regions in each FIGURE represent regions of relatively high energy density. As shown in these FIGS., for each pattern viewed side to side, the regions of relatively high energy density are interspersed with regions of relatively low energy density. As best seen in FIG. 9 which represents the superposition of the two patterns, the first pattern is displaced laterally relative to the second pattern such that the regions of high energy density of each pattern overlie regions of low energy density of the other. By periodically switching from one pattern to the other the time-averaged uniformity of energy density at the cooking plane is greatly enhanced.

Referring again to FIG. 4, the arrangements for the radiating apertures 90 to provide the two different radiation patterns will now be described. Each of apertures 90 in the illustrated embodiment is constructed as a series slot; that is, the longitudinal axis of the slot is oriented transverse to the direction of wave propagation in guide section 50. The dimensions of the slots are chosen with a view to evenly distributing the energy along the radiating chamber and to provide the desired impedance matching. Specifically, slot lengths were chosen at substantially less than one-half a waveguide length so as to provide non-resonant slots. This assures that energy is relatively evenly distributed along the length of guide section 50 rather than radiating primarily from those slots nearest the entrance to section 50.

Slots 90 are arranged in two staggered rows, designated generally A and B. Within each row the lateral spacing between the slots is one-quarter guide wavelength. Slot A-1 is located one-quarter wavelength from end wall 65. Thus, all the slots of Row A are centered an integral multiple of quarter guide wavelengths from end wall 65. When guide 50 is terminated by an open circuit at end wall 65, slots A-1, A-3, A-5 and A-7 are centered at minimum field or standing wave points which correspond to maximum power coupling points for series slots, while slots A-2, A-4 and A-6 are at minimum power coupling points. When guide 50 is terminated by a short circuit at end wall 65, this situation is reversed with slots A-2, A-4 and A-6 being centered at maximum power coupling points and slots A-1, A-3, A-5 and A-7 being at minimum coupling points.

Slot B-1 is centered one-eighth guide wavelength from end wall 65. Consequently, slots B-1–B-7 are each centered at odd integral multiples of eighth guide wavelengths from end wall 65. Thus, slots B-1–B-7 are centered at half power coupling points, i.e., midway between the maximum and minimum power coupling points regardless of whether the first or second phase relationship exists in guide section 50, i.e., regardless of whether the section is terminated in an open circuit or a short circuit at end wall 65.

The radiation pattern at the cooking plane is the result of the interference of radiation from the slots of Row B with those slots of Row A centered at the maximum coupling points. More specifically, the radiation from each maximum power point slot in Row A constructively interferes with the radiation from its immediately adjacent half power point slots of Row B to form a region of high energy density at the cooking plane over each three slot cluster.

Referring again to FIGS. 7 and 8, when guide section 50 is open circuit terminated, high intensity region O-1 is formed by radiation from slots A-3, B-3 and B-4; region O-3 is formed by radiation from slots A-5, B-5 and B-6; and region O-4 is formed by radiation from slots A-7 and B-7. High intensity region O-5 to the extreme left is formed primarily by radiation from aperture 66. When guide 50 is short circuit terminated, region S-1 is formed by radiation from slot B-1; region S-2 is formed by radiation from slots A-2, B-2 and B-3; region S-3 is formed by radiation from slots A-4, B-4 and B-5; and region S-4 is formed by radiation from slots A-6, B-6 and B-7.

Thus, slots A-1, A-3, A-5, A-7, and B-1–B-7 form a first set of slots which establish a first stationary patten of radiation at the cooking plane when the first phase relationship exists in waveguide 50. Slots A-2, A-4, A-6 and B-1–B-7 form a second set of slots which establish a second stationary pattern of radiation at the cooking plane when the second phase relationship exists in waveguide section 50.

It remains to describe the means for periodically shifting the phase of the standing wave in guide section 50. In the illustrative embodiment of FIGS. 1–5, means for periodically varying the phase of the standing wave is pivoted by a solenoid actuated device which effectively switches the termination between an open circuit termination and a short circuit termination. Solenoid device 92 comprises a solenoid coil 94, supported on a mounting bracket 96 which is suitably secured such as by welding to bottom cavity wall 30 proximate end wall 65 of waveguide section 50. Coil 94 includes a pair of terminals for connection to a power supply (not shown). A reciprocating solenoid actuated conductive rod or plunger 100 is aligned with an opening in bottom cavity wall 30 in close lateral proximity to end wall 65 and located centrally side to side in the waveguide for movement between an open circuit position and a short circuit position. When coil 94 is de-energized, rod 100 is retracted to its open circuit position into the central region of the coil remote from the internal region of waveguide section 50. In this position, the rod has essentially no effect on the field in guide section 50. When coil 94 is energized, rod 100 moves upwardly through the bottom wall opening into guide section 50 to its short circuit position. In this short circuit position, the longitudinal rod axis is parallel to the direction of the electric field established in guide section 50 with the free end 102 of rod 100 closely adjacent top wall 72 of guide section 50. When so positioned, rod 100 effectively converts the open circuit termination of guide 50 to a short circuit termination, thereby effectively shifting the standing wave established in guide section 50 by a quarter guide wavelength.

Thus, when solenoid coil 94 is de-energized, rod 100 is retracted from guide section 50; waveguide section 50 is terminated by an open circuit; the first phase relationship for the standing wave is established in the waveguide; and the first radiation pattern is established at the cooking plane. When solenoid coil 94 is energized, rod 100 is moved to its short circuit position; guide section 50 is effectively terminated by a short circuit at end wall 65; the standing wave is shifted a quarter wavelength, establishing the second phase relationship for the standing wave in the waveguide; and the second radiation pattern is established at the cooking plane.

By appropriately programming the control system of the oven to periodically energize and de-energize solenoid coil 94, rod 100 is periodically reciprocated between its first and second positions, thereby periodicaly shifting the standing wave between the first phase relationship and the second phase relationship. The frequency of actuation of solenoid coil 94 is not believed critical so long as it is sufficient to provide the desired averaging of the energy distribution. A satisfactory range is believed to be from 0.1 second to 10 seconds.

As hereinbefore described, support plate 37 is disposed in cavity 24 for supporting food items to be heated in the cavity. Vertical spacing of plate 37 above guide section 50 is selected for desired impedance matching. This spacing significantly affects energy intensity at the bottom of food loads supported on plate 37. Different spacing may provide optimum results for different size loads. In the illustrative embodiment, a nominal spacing of approximately 0.18 inches was selected to provide satisfactory performance for a wide range of typical food load sizes. For loads of sufficient size to couple all of the slots, a greater spacing may provide optimum cooking performance; for smaller than normal loads, less separation may provide better performance.

The spacing which provides the desired impedance matching also enables support plate 37 to serve as a refracting member for the energy radiated from radiating guide section 50 as well as energy reflected from bottom cavity wall 30. The refracting function of plate 37 tends to laterally spread the energy radiation pattern radiated from slots 90 to more widely distribute this energy in cavity 24.

Bottom wall 30 of the oven cavity 24 has surfaces 104 and 106 which are bent or sloped upwardly from flat central section 108 to the front and rear walls, respectively, of the cavity. These surfaces operate primarily to reflect microwave energy from the upper waveguide section 46 upwardly and centrally toward the food to be heated, which is usually located in the center portion of the oven. To this end the reflective surfaces are bent upwardly at an angle to the horizontal of between 3 and 4 degrees. The exact angle is chosen based on various parameters such as dielectric constant and typical foods to be cooked in the oven and its location in the oven cavity. In the illustrative embodiment, this angle is about 8 degrees to the horizontal.

While in the illustrative embodiment the angular reflected surfaces are provided in the bottom wall, it will be clear to those skilled in the art that such angle reflective surfaces could be located on other walls of the oven in an analogous manner. The overall result of redirecting energy impinging thereon from the interior of the cavity toward the central portions of the oven would take place.

Figure 11:
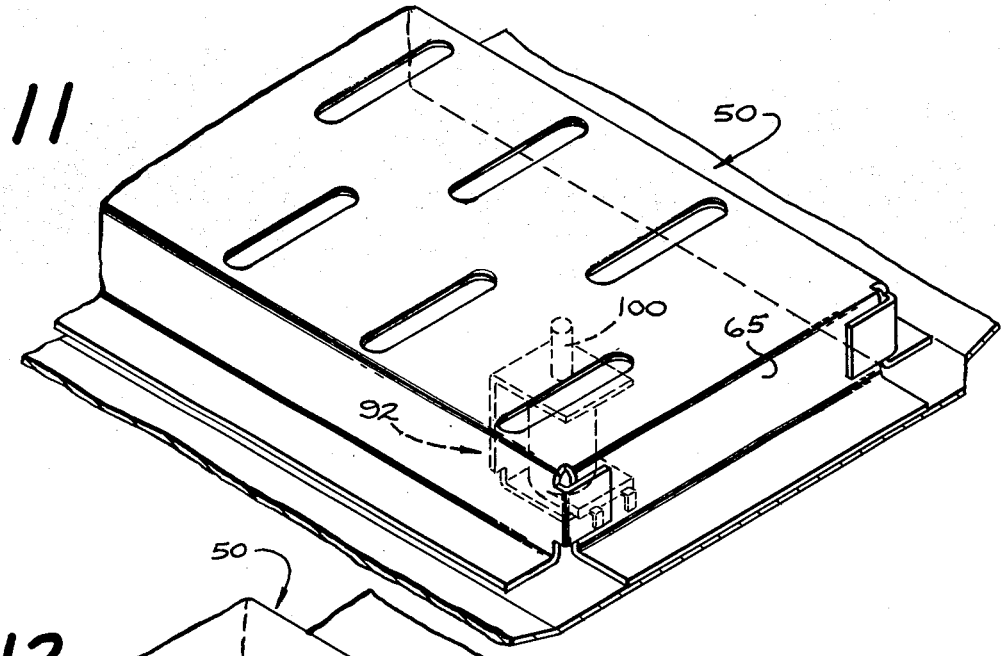
FIGS. 11–13 are enlarged perspective views of a portion of the bottom waveguide of the oven of FIG. 1 incorporating alternative embodiments of phase shifting devices.

While having hereinbefore described an illustrative embodiment in which the bottom guide section 50 is structurally terminated by aperture 66 in end wall 65, it will be apparent to those skilled in the art that similar performance could be achieved by structurally terminating the guide section with a conductive end wall with no aperture. In such an arrangement the end wall would provide a short circuit termination. To introduce the desired quarter wavelength shift of the standing wave, a shifting means such as solenoid device 92 could still be used; however, it would be positioned a quarter wavelength from end wall 65, as shown in FIG. 11. In such an arrangement, insertion of rod 100 into the guide section introduces a short circuit termination at what would otherwise be a maximum field point, thereby providing the desired quarter wavelength shifting in the standing wave.

Figure 10:
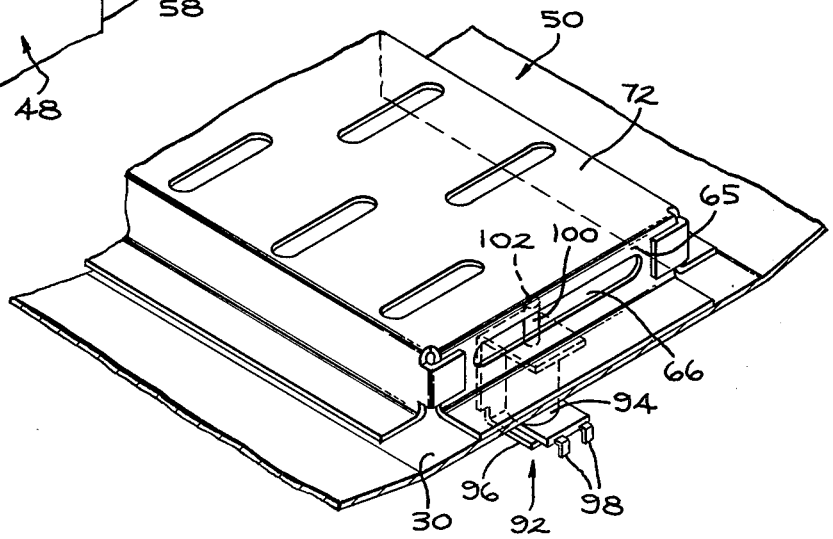
FIG. 10 is an enlarged perspective view of a portion of the bottom waveguide removed from the oven of FIG. 2 to show details of the solenoid actuated phase shifting device of the embodiment of FIG. 2.
Figure 2:
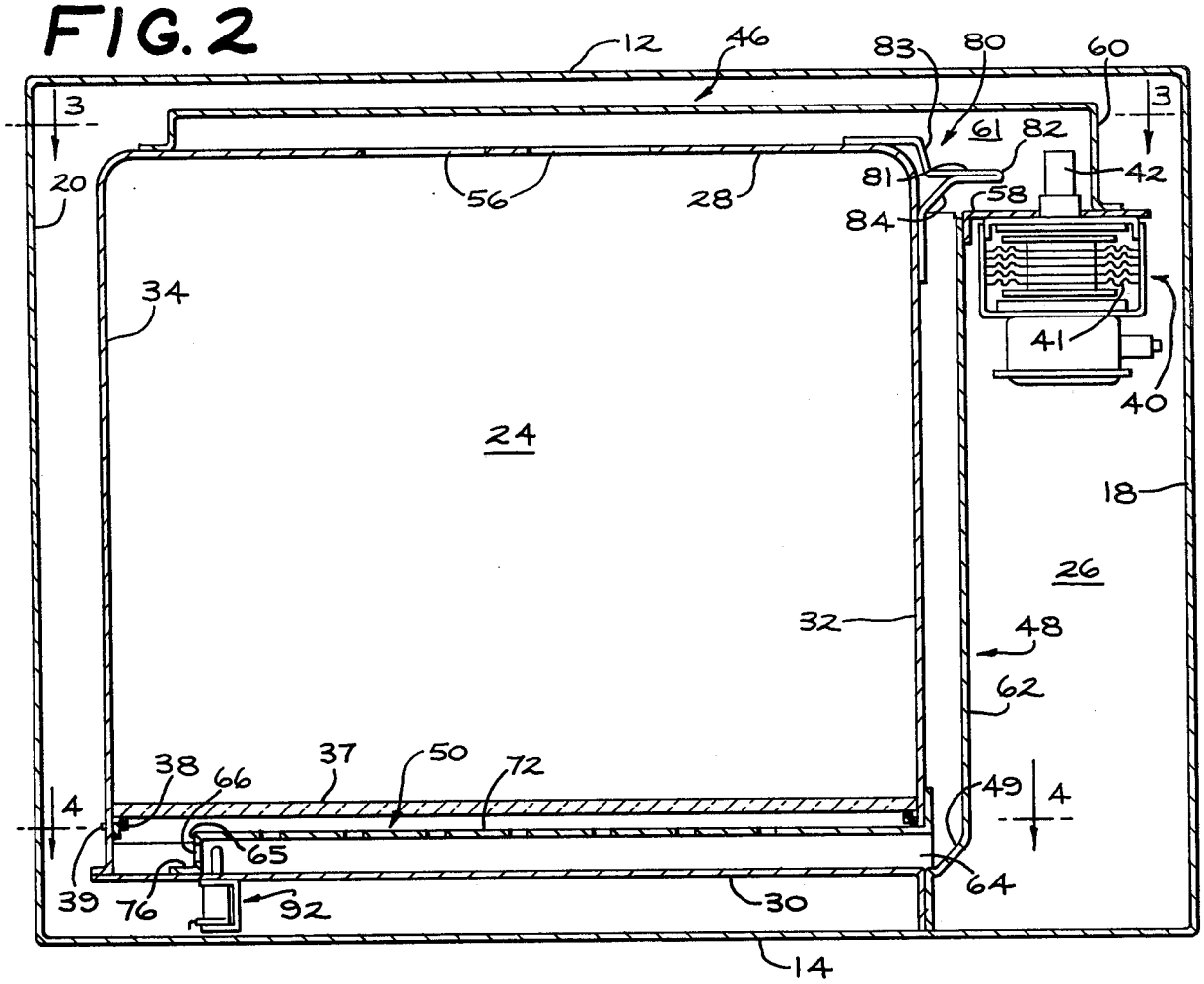
FIG. 2 is a front schematic sectional view of the microwave oven taken along lines 2—2 of FIG. 1.
Figure 12:
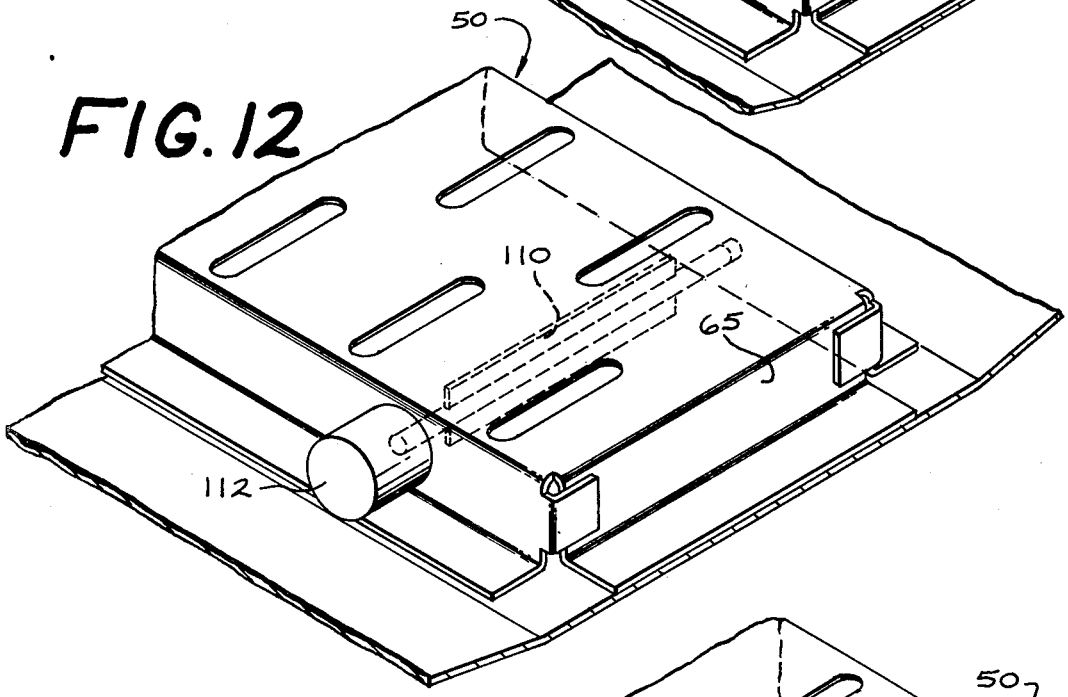
Figure 13:
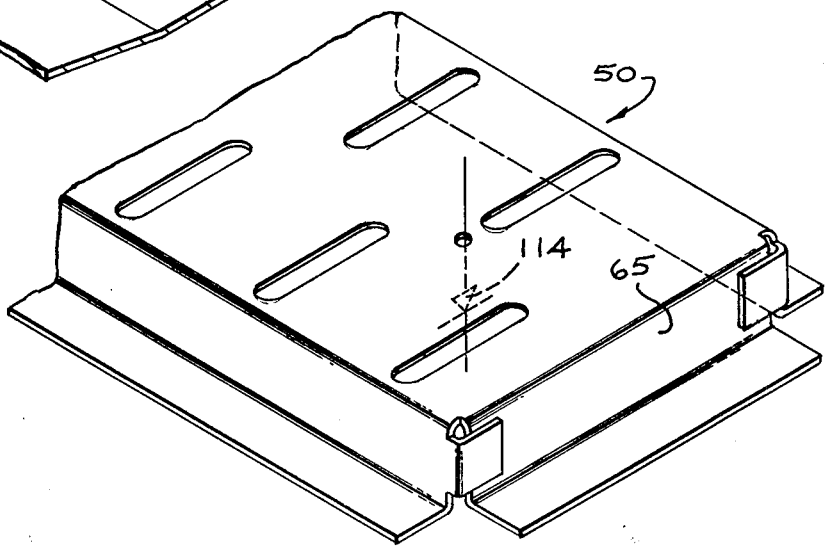

It will also be apparent to those skilled in the art that other means could readily be employed to introduce the desired short circuit termination either at the end wall when apertured as in FIG. 10, or a quarter wavelength removed from the end wall as in FIGS. 11–13.

FIGS. 12 and 13 illustrate alternative means for shifting the phase of the standing wave. In FIG. 12, a planar conductive flap 110 is pivotally supported from the side walls of guide section 50 for rotational movement. When the plane of flap 110 is aligned parallel to end wall 65, it substantially spans the space between top and bottom guide walls, thereby introducing a short circuit termination at the flap. When the flap is rotated 90° from its short circuit position, the flap has no substantial effect on the field supported in the guide. In this arrangement, a stepping motor schematically depicted at 112 periodically rotates the flap between its short circuit and open circuit positions to periodically shift the phase of the standing wave in guide section 50.

Yet another alternative is depicted schematically in FIG. 13. In this embodiment, a PIN diode 114 is disposed within section 50 a quarter wavelength from closed conductive end wall 65. Diode 114, when reverse biased, has no effect on the field in guide section 50. However, when forward biased, the diode acts as a short circuit termination. Thus, the desired periodic shifting of the phase relationship of the standing wave in the waveguide section is achieved by periodically forward biasing diode 114.

It is also to be understood that while in the illustrative embodiments described herein, the waveguide section employed to radiate the two different radiating patterns is displayed as the bottom waveguide, such an arrangement could likewise be employed in a top waveguide feed system.

While specific embodiments of the invention have been illustrated and described herein, it is realized that numerous other modifications and changes will occur to those skilled in the art. It is therefore to be understood that the appended claims are intended to cover all such modifications and changes as fall within the true spirit and scope of the invention.

What is claimed is:

1. An excitation system for a microwave oven cooking cavity having electrically conductive walls, said excitation system promoting time-averaged uniformity of energy distribution and comprising:

a source of microwave energy;

a hollow rectangular feed waveguide extending along one wall of the cooking cavity, said waveguide being coupled at one end to said source of microwave energy to establish an electric field between opposing walls thereof, characterized by a standing wave field pattern;

means for periodically varying the termination of said waveguide between an open circuit termination and a closed circuit termination whereby the phase of the standing wave varies between a first phase relationship and a second phase relationship, respectively;

said waveguide including an array of radiating apertures spaced apart along the length thereof for feeding microwave energy into the cooking cavity; said array of apertures being arranged to support a first essentially stationary pattern of radiation in the cavity when said first phase relationship exists in said waveguide, and to support a second essentially stationary pattern of radiation in the cavity when said second phase relationship exists in said waveguide; each of said first and second radiating patterns being characterized by regions of relatively high energy density interspersed with regions of relatively low energy density, said second pattern being laterally displaced relative to said first pattern such that the regions of relatively high and low energy density of said second pattern substantially overlay the regions of relatively low and high energy density, respectively, of said first pattern.

2. An excitation system according to claim 1 wherein said array of radiating apertures includes a first row of series slots laterally spaced along the length of said waveguide, each centered an integral number of quarter wavelengths of the standing wave from said waveguide termination, and a second row of series slots parallel to said first row, each of said second row slots being centered an odd integral number of eighth wavelengths of the standing wave from said waveguide termination.

3. An excitation system according to claim 2 wherein said waveguide includes an end wall at the end remote from said one end and wherein said means for varying the termination of said waveguide comprises an open circuit termination formed by a terminating aperture in said end wall and a means for periodically providing an electrical short circuit across said terminating aperture whereby said first phase relationship is shifted by a quarter-wavelength of the standing wave relative to said second phase relationship.

4. A microwave cooking appliance comprising:

a cooking cavity for containing objects to be heated therein;

means for supporting objects to be heated in said cavity, said means defining a cooking plane in said cavity;

a source of microwave energy;

a hollow microwave energy radiating structure arranged to support therein an electric field characterized by a standing wave;

means for coupling microwave energy from said source to said radiating structure to establish said electric field;

means for periodically shifting the phase of the standing wave in said radiating structure between a first phase relationship and a second phase relationship;

said radiating structure including an array of radiating apertures spaced apart along the length thereof for coupling microwave energy from said radiating structure to said cooking cavity, said array of apertures being arranged to establish a first essentially stationary radiation pattern in said cooking cavity when said first phase relationship for said standing wave is established in said radiating structure and to support a second essentially stationary radiation pattern in said cooking cavity, when said second phase relationship for said standing wave is established in said radiating structure, each of said first and second radiating patterns being characterized at the cooking plane by regions of relatively high energy density and relatively low energy density, said first and second sets of apertures being arranged such that the relatively high and relatively low energy density regions of said first radiating pattern substantially overlay the relatively low and relatively high energy density regions, respectively, of said second pattern;

whereby a dynamic radiating pattern is provided at said cooking plane by said radiating structure which provides a relatively uniform time averaged radiation pattern at the cooking plane.

5. The microwave cooking appliance of claim 4 wherein said radiating structure is terminated by a conductive end wall having an aperture formed therein to provide an open circuit termination for said radiating structure and wherein said means for periodically shifting the phase of the standing wave comprises termination shifting means for periodically providing a short circuit termination for said radiating structure, thereby introducing a quarter-wavelength phase shift of the standing wave in said chamber when said shifted short circuit termination is provided.

6. The microwave cooking appliance of claim 1 wherein said array of radiating apertures includes a first row of series slots laterally spaced along the length of said radiating structure, each of which is centered an integral number of quarter wavelengths of the standing wave from said conductive end wall, and a second row of series slots parallel to said first row, each of said slots in said second row being centered an odd integral number of eighth wavelengths of the standing wave from said conductive end wall.

7. The microwave cooking appliance of claim 6 wherein said termination shifting means comprises a conductive rod arranged for reciprocal movement between a short circuit position in which said rod extends into said structure substantially spanning the space between opposing side walls thereof, the longitudinal axis of said rod extending parallel to the electric field in close proximity to said end wall, and an open circuit position remote from the interior of said radiating structure.

8. A microwave cooking appliance comprising:

a cooking cavity for containing objects to be heated;

means for supporting the objects in said cavity defining a cooking plane;

a source of microwave energy;

a hollow rectangular radiating structure extending along one wall of said cooking cavity constructed to support an electric field between opposing walls thereof, said field being characterized by a standing wave;

means for coupling microwave energy from the source to said radiating structure to establish said electric field therein;

means for periodically shifting the phase of the standing wave in said radiating structure;

said radiating structure having spaced apart along the length thereof an array of radiating apertures for coupling microwave energy from said structure into said cavity, said array including a first set of apertures arranged to radiate when the unshifted standing wave is established in said radiating structure and a second set of apertures arranged to radiate when the shifted standing wave is established in said radiating structure;

the radiation pattern of each set of apertures being essentially stationary and characterized by regions of relatively high energy density and regions of relatively low energy density, the pattern of said first set being offset laterally relative to said second set at the cooking plane such that the relatively high and relatively low energy density regions of the first set of apertures overlays the relatively low and relatively high energy density regions, respectively, of the second set of apertures whereby the time averaged energy density at the cooking plane is relatively uniform.

9. The microwave cooking appliance of claim 8 wherein said radiating structure is terminated at one end thereof by a conductive end wall and wherein said means for periodically shifting the phase of the standing wave comprises termination means operative to selectively introduce a short circuit termination in said radiating structure at a shift location displaced from said end wall along its longitudinal axis by an integral number of quarter-wavelengths of the standing wave.

10. The microwave cooking appliance of claim 9 wherein said array of radiating apertures includes a first row of series slots laterally spaced along the length of said radiating structure, each slot being centered an integral number of quarter wavelengths of the standing wave from said end wall and a second row of series slots extending parallel to said first row, each of said second row slots being centered an odd integral number of eighth wavelengths of the standing wave from said end wall.

11. The microwave cooking appliance of claim 10 wherein said termination means comprises a conductive rod arranged for reciprocal movement between a short circuit position in which said rod extends between said opposing side walls parallel to the electric field at said shift location and an open circuit position in which said rod is substantially withdrawn from the interior of said structure.

12. The improvement of claim 10 wherein said phase shifting means comprises a conductive plate rotatably mounted in said structure for movement between an open circuit position in which said plate is substantially perpendicular to said electric field and a short circuit position in which said plate is substantially parallel to said electric field, the axis of rotation of said plate extending parallel to said end wall and being displaced therefrom by a quarter-wavelength of the standing wave.

13. The microwave cooking appliance of claim 10 wherein said termination means comprises an electronic switching device coupled to an external voltage supply and extending between said opposing walls at said shift location having a conductive state and a non-conductive state and operative in its conductive state to provide a short circuit termination.

* * * * *

UNITED STATES PATENT AND TRADEMARK OFFICE

CERTIFICATE OF CORRECTION

PATENT NO. : 4,464,554

DATED : August 7, 1984

INVENTOR(S) : Stephen M. Bakanowski and Matthew S. Miller

It is certified that error appears in the above-identified patent and that said Letters Patent is hereby corrected as shown below:

Column 12, line 55, "claim 1" should read --claim 5--.

Signed and Sealed this

*Eighth* Day of *January 1985*

[SEAL]

*Attest:*

*Attesting Officer*

GERALD J. MOSSINGHOFF

*Commissioner of Patents and Trademarks*